US007856200B2

(12) United States Patent
Wada et al.

(10) Patent No.: US 7,856,200 B2
(45) Date of Patent: Dec. 21, 2010

(54) SEMICONDUCTIVE BELT, SEMICONDUCTIVE ROLL AND IMAGE FORMING APPARATUS USING THESE MEMBERS

(75) Inventors: Noboru Wada, Kanagawa (JP); Kazuo Sueyoshi, Kanagawa (JP); Tetsuya Kawatani, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 867 days.

(21) Appl. No.: 11/503,987

(22) Filed: Aug. 15, 2006

(65) Prior Publication Data

US 2007/0184252 A1 Aug. 9, 2007

(30) Foreign Application Priority Data

Feb. 3, 2006 (JP) ..... P2006-026588

(51) Int. Cl.
*G03G 15/01* (2006.01)

(52) U.S. Cl. ..... 399/303; 430/56; 430/124.1; 430/125.1; 399/346; 399/308; 399/312; 399/313; 428/195.1

(58) Field of Classification Search ..... 399/308, 399/346, 303, 312, 313; 428/195.1; 430/56, 430/124, 125

See application file for complete search history.

(56) References Cited

U.S. PATENT DOCUMENTS

| | | | | |
|---|---|---|---|---|
| 6,562,529 | B1 * | 5/2003 | Kojima et al. | 430/56 |
| 6,820,738 | B2 * | 11/2004 | Hara et al. | 198/844.2 |
| 7,352,984 | B2 * | 4/2008 | Matsuda et al. | 399/297 |
| 2003/0165757 | A1 * | 9/2003 | Kojima et al. | 430/56 |

FOREIGN PATENT DOCUMENTS

| | | |
|---|---|---|
| JP | A 4-177377 | 6/1992 |
| JP | A 6-118105 | 4/1994 |
| JP | A 7-271204 | 10/1995 |
| JP | A 8-185068 | 7/1996 |
| JP | A 8-292648 | 11/1996 |
| JP | A 9-179414 | 7/1997 |
| JP | A 2004-078029 | 3/2004 |

* cited by examiner

*Primary Examiner*—Mark Ruthkosky
*Assistant Examiner*—Tamra L Amakwe
(74) *Attorney, Agent, or Firm*—Oliff & Berridge, PLC

(57) ABSTRACT

A semiconductive belt includes: at least one different resistance portion that is configured to partly differ in surface resistance from surroundings, wherein the at least one different resistance portion is at an angle with respect to a direction perpendicular to a belt end portion.

9 Claims, 10 Drawing Sheets

FIRST EXAMPLE

FIRST COMPARTIVE EXAMPLE

SECOND COMPARATIVE EXAMPLE (DIE)

SECOND COMPARATIVE EXAMPLE (PRESS MOLDING)

SEMICONDUCTIVE BELT, SEMICONDUCTIVE ROLL AND IMAGE FORMING APPARATUS USING THESE MEMBERS

BACKGROUND

1. Technical Field

The present invention relates to a semiconductive belt, to a semiconductive roll, and to an image forming apparatus using these members.

2. Related Art

In an image forming apparatus utilizing an electrophotographic method, uniform electric charge is formed on a surface of a latent image carrier (photoreceptor (that is, the surface of the photoreceptor is uniformly electrically charged)). Then, an electrostatic latent image is formed by laser beams obtained by modulating image signals. Subsequently, a toner image is formed by developing an electrostatic latent image with charged toner. Then, the toner image is electrostatically transferred onto a recording medium through an intermediate transfer member or directly. Thus, a desired transfer image is obtained.

In recent years, such image forming apparatuses, for example, a printer and a copying machine have employed semiconductive members for various purposes. To aim for high picture quality, a long life, and environmental improvement, the semiconductive members have been achieving great progress. More specifically, examples of the uses of semiconductive members, such as a semiconductive rotating roll, are the overall basic processes of the electrophotographic method, for instance, electrification, exposure, development, transfer, cleaning, and neutralization processes.

For example, a transfer method using an intermediate transfer member employs a semiconductive endless belt (semiconductive belt). The semiconductive belt is generally made of an elastic material from the viewpoint of easiness of controlling thereof while driving. Generally, vulcanized rubber materials, for instance, ethylene-propylene-diene monomer (EPDM) rubber, urethane rubber, epichlorohydrin rubber, polychloroprene rubber, and blend rubber obtained by mixing these kinds of rubbers, are used as the elastic material.

A transfer/conveyance belt holds a method of holding a transferring material (recording medium) through an electrostatic adsorption force. Thus, to obtain favorable picture quality, uniformity of the in-plane resistance of the belt is necessary. This is because of the following facts. That is, in a case where the value of resistance is low at a part of the surface of the belt, an electric discharge occurs, so that the belt or the image carrier is damaged and that disturbance of an image transferred onto a surface of a transferring material occurs. Also, in a case where the volume resistivity value of the belt is high, an electric discharge phenomenon is caused by holding the transferring material at a high voltage. This results in a transfer defect in which a part of toner provided on the surface of the transferring material has a reverse polarity. Also, an image defect called a void is caused in a part of the surface of the transferring material. Also, in a case where the transfer/conveyance belt partly has a low volume resistivity, electric charge easily flows to a local area, in which the resistivity is low, in the surface of the belt. Consequently, the transferring material cannot be held through the electrostatic adsorption force.

Although a transferring voltage ranging from 1 kV to 5 kV is applied so as to cause the semiconductive belt to hold the transferring material and as to transfer the toner image onto the transfer material, the resistance value of the material of the belt changes due to the voltage applied thereto, so that the resistance value sometimes varies between a part, on which the transfer material is provided, and another part, on which no transfer material is provided, in the belt (that is, a belt resistance value variation sometimes occurs therein).

Meanwhile, rotating rolls, such as a charging roll, a transfer roll, a backup roll, a cleaning roll, and a development sleep, require the uniformity of the electrical resistance value, the nip pressure between the roll and each of an image carrier and an intermediate transfer member, and the width of the roll. Usually, a predetermined electrically conductive filling material is mixed into the material of the roll.

SUMMARY

According to an aspect of the invention, there is provided a semiconductive belt including: at least one different resistance portion that is configured to partly differ in surface resistance from surroundings, wherein the at least one different resistance portion is at an angle with respect to a direction perpendicular to a belt end portion.

BRIEF DESCRIPTION OF THE DRAWINGS

Exemplary Embodiment(s) of the present invention will be described in detail based on the following figures, wherein.

DETAILED DESCRIPTION

A semiconductive belt and a semiconductive roll, to which the invention is applied, can be widely used as electrically conductive members used in a charging unit, a developing unit, and a transfer unit of an electrophotographic image forming apparatus.

Hereinafter, a best mode (exemplary embodiment) for carrying out the invention is described. Incidentally, the invention is not limited to the following exemplary embodiment. Various modifications can be made without departing from the spirit and scope of the invention. The accompanying drawings are used for illustrative purpose only and do not indicate the actual size of the present exemplary embodiment.

First, an example of an image forming apparatus employing a semiconductive belt and a semiconductive roll, to which the present exemplary embodiment of the invention is applied, is described below with reference to the accompanying drawings.

Figure 1:
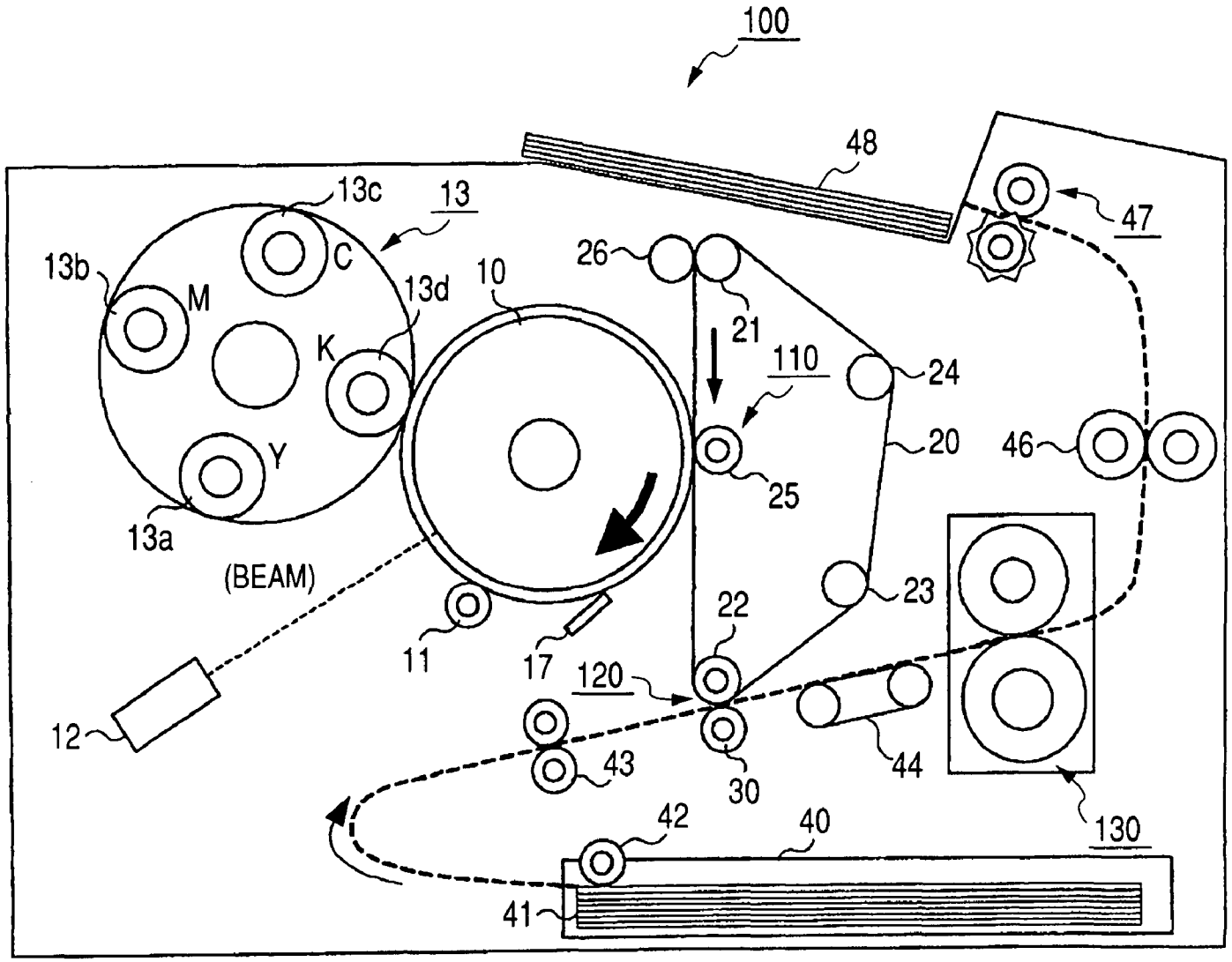
FIG. 1 is a diagram illustrating an image forming apparatus to which an exemplary embodiment of the invention is applied.

FIG. 1 is a diagram illustrating an image forming apparatus to which the present exemplary embodiment is applied. An image forming apparatus 100 shown in FIG. 1 includes a primary transfer unit 110 adapted to sequentially transfer toner images of color components (Y (yellow), M (magenta), C (cyan), and K (black) in this exemplary embodiment) onto an intermediate transfer belt 20 (that is, perform the primary transfer of the toner images thereonto sequentially). The image forming apparatus 100 also includes a secondary transfer unit 120 adapted to collectively transfer superposed toner images, which are transferred onto the intermediate transfer belt, onto a recording material (that is, perform the secondary transfer of the superposed toner images thereonto). The image forming apparatus 100 also includes a fixing unit 130 adapted to fix the images, the secondary transfer of which is performed, to the recording material. Additionally, the image forming apparatus 100 includes a control portion (not shown) adapted to control an operation of each unit (or portion). The intermediate transfer belt 20 is put into contact with a predetermined area of an image carrier 10 along the shape of the image carrier 10.

The image carrier 10 has a charging unit 11 that is provided with a photosensitive layer whose resistance value is lowered by irradiating light thereon and that is adapted to electrify the image carrier 10 provided therearound. The image carrier 10 also has an exposure unit 12 adapted to write electrostatic latent images of the color components (Y, M, C, K) onto the charged image carrier 10, a rotary type developing unit 13 adapted to visualize each of the latent images of the color components, which are formed on the image carrier 10, by toner of a corresponding color component, the intermediate transfer belt 20, and a cleaning unit 17 adapted to clean up residual toner provided on the image carrier 10. When needed, a discharging unit may be disposed thereon.

An example of the charging unit 11 is a charging device, such as a charging roll, and a corotron. Also, any exposing device may be used as the exposure unit 12, as long as the exposing device can write an image onto the image carrier 10 by using light. For example, a print head using LED, a print head using EL, or a scanner configured to scan an image with laser beams by using a polygon mirror can suitably be selected as the exposure unit 12.

The rotary type developing unit 13, on which developing devices 13*a* to 13*d* each accommodating toner of a corresponding color are rotatably mounted, can suitably be selected, as long as the developing unit can make toner of each color component to adhere to, for instance, a part, whose potential level is lowered due to exposure, on the image carrier 10. There is no particular limitation to the shape and the particle size of the toner. As long as toner can be applied onto an electrostatic latent image formed on the image carrier 10, any toner may be used. Although the rotary type developing unit 13 is used in the apparatus shown in FIG. 1, four developing units may be used.

For example, a cleaning unit of the blade cleaning type can suitably be selected as the cleaning unit 17 to clean the residual toner on the image carrier 10.

As shown in FIG. 1, the intermediate transfer belt 20 is stretched over four stretched rolls 21 to 24 and is disposed close to a predetermined touch area of the surface of the image carrier 10 placed between the rotary type developing unit 13 and the cleaning unit 17. As shown in FIG. 1, the intermediate transfer belt 20 and the image carrier 10 are driven by different drive systems, respectively.

The primary transfer roll 25 is disposed to be in contact with a part of the touch area that is in close contact with the image carrier 10 from the rear side of the intermediate transfer belt 20. A predetermined primary transfer bias voltage is applied thereto.

A secondary transfer roll 30 is placed at a part, which faces the stretched roll 22 on the intermediate transfer belt 20, by employing the roll 22 as a backup roll. For instance, a predetermined secondary transfer bias voltage is applied to the secondary transfer roll 30. The stretched roll 22 also serving as the backup roll is grounded.

A cleaning roll 26 is disposed at a part, which faces the stretched roll 23 on the intermediate transfer belt 20. A predetermined cleaning bias voltage is applied to the cleaning roll 26. The stretched roll 21 is grounded.

Next, a basic image forming process performed by the image forming apparatus 100 is described below. The image forming apparatus 100 performs predetermined image processing on image data outputted from an image reading apparatus (not shown). Thereafter, color tonal data of four colors Y, M, C, and K are converted by developing devices 13*a* to 13*d*. Then, the converted data is outputted to the exposure unit 12.

After a surface of the image carrier 10 is electrified by the charging unit 11, the surface thereof is scanned and exposed by the exposure unit 12, so that an electrostatic image is formed. The formed electrostatic image is developed as the toner image of each of the colors Y, M, C, and K.

The toner images formed on the image carrier 10 are transferred onto the intermediate transfer belt 20 by the primary transfer unit 110 against which the image carrier 10 and the intermediate transfer belt 20 abut.

Upon completion of transfer of the toner images onto the intermediate transfer belt 20, the intermediate transfer belt 20 moves to thereby convey the toner images to the secondary transfer unit 120. When the toner images are conveyed to the secondary transfer unit 120, a paper conveyance system rotates a paper feeding roll 42 in synchronization with timing, with which the toner images are conveyed to the secondary transfer unit 120, so that a recording material of a predetermined size is supplied from a supply tray 40. The recording material supplied from the paper feeding roll 42 reaches the secondary transfer unit 120 through a recording material path. Before reaching the secondary transfer unit 120, the recording material is once stopped. Then, the position of the recording material is adjusted to that of the toner image by rotating the resist roll 43 in synchronization with the timing with which the intermediate transfer belt 20 moves.

In the secondary transfer unit 120, the secondary transfer roll 30 is pushed against the stretched roll 22 serving as the backup roll. At that time, the recording material 41 conveyed in synchronization therewith is sandwiched between the intermediate transfer belt 20 and the secondary transfer roll 30. Then, when a voltage (secondary transfer bias voltage) of a polarity, which is the same as the charging polarity of the toner (that is, a negative polarity), is applied thereto from a power supply roll (not shown), a transfer electric field is generated between the secondary transfer roll 3 and the stretched roll 22. Unfixed toner images carried on the intermediate transfer belt 20 are collectively electrostatically transferred onto the recording material 41.

Subsequently, the recording material 41, onto which the toner images are electrostatically transferred, is conveyed by the secondary transfer roll 30 to a conveyance belt 44 provided downstream side in a direction of the secondary while maintaining a state in which the recording material 41 is peeled from the intermediate transfer belt 20. The conveyance belt 44 conveys the recording medium 41 to the fixing unit 130 at an optimum conveyance speed for the fixing unit 130. The unfixed toner images on the recording material 41 conveyed to the fixing unit 130 are fixed to the recording material 41 by undergoing fixing that is performed by the fixing unit 130 using heat and a pressure. Then, the recording material 41, on which the fixed images are formed, is discharged to a discharge tray 48 through a conveyance roll 46 and a paper conveyance unit 47.

Meanwhile, upon completion of transfer of the images to the recording material 41, the residual toner left on the intermediate transfer belt 20 are conveyed to the cleaning roll 26 as the intermediate transfer belt 20 turns. Thus, the residual toner is removed from the intermediate transfer belt 20.

Next, the semiconductive belt used in the image forming apparatus 100 according to the present exemplary embodiment is described below by taking the intermediate transfer belt 20 as an example.

Figure 2A:
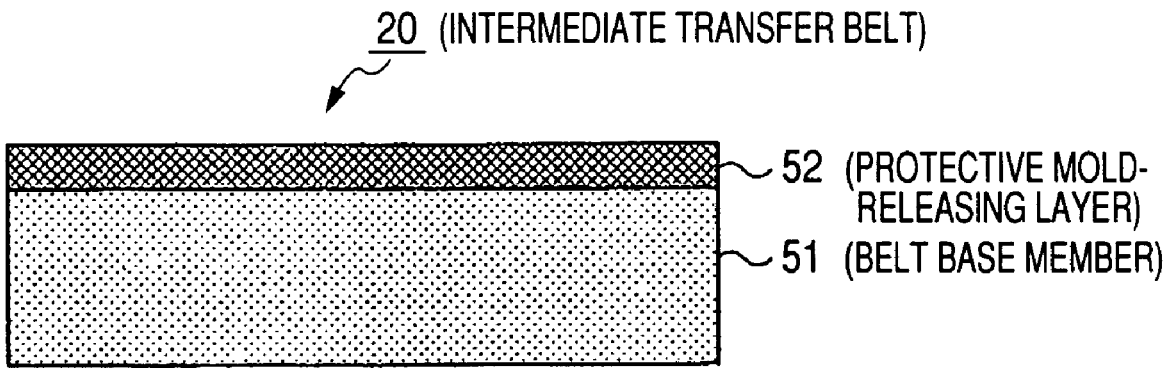
FIGS. 2A and 2B are diagrams respectively illustrating the structures of an intermediate transfer belt and a secondary transfer roll, which are exemplary examples of a semiconductive member.
Figure 2B:
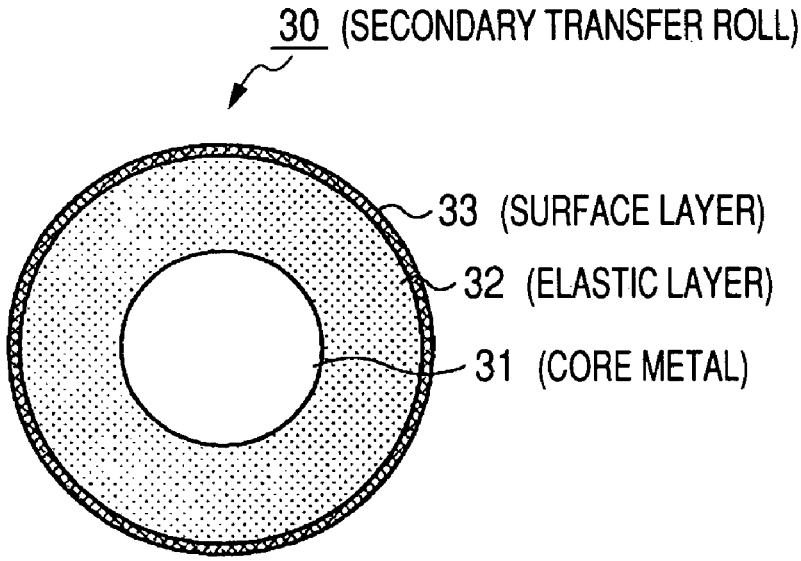

FIGS. 2A and 2B are diagrams illustrating the structures of the intermediate transfer belt 20 and the secondary transfer roll 30, which are examples of the semiconductive members. FIG. 2A is a diagram illustrating the structure of the intermediate transfer belt 20 that is an example of the semiconductive belt. As shown in FIG. 2A, the intermediate transfer belt 20 has a belt base member 51, which includes an elastic material, and a protective mold-releasing layer 52 provided on the surface of the belt base member 51. The belt base member 51 may be constituted by either a single layer or a plurality of layers that are one or more layers provided on the belt base member 51.

The thickness of the belt base member 51 usually ranges from about 350 μm to about 800 μm. Also, the thickness of the protective mold-releasing layer 52 usually ranges from about 1 μm to about 20 μm.

Examples of the material of the belt base member 51 are vulcanized rubbers and thermoplastic elastomers. The vulcanized rubber is obtained by performing vulcanization-molding on raw material rubber using a predetermined vulcanizing agent. Examples of the raw material rubber are diene rubbers, such as a styrene butadiene rubber (SBR), a poly-isoprene rubber (IR), and a polybutadiene rubber (BR), and a heat-resistant and weather-proof rubbers, such as a hydrogenated acrylonitrile butadiene rubber (HNBR), a chloroprene rubber (CR), an epichlorohydrin rubber (CHR), a polyurethane rubber (PUR), an acrylic rubber (ACM, ANM), and an ethylene propylene diene (EPDM) rubber. Among these rubbers, the heat-resistant rubber is preferable, because of a relatively high stiffness, a volume resistivity, which is close to that of a semiconductive material, and a favorable fluidity thereof in a die.

Examples of a thermoplastic elastomer are a polyester thermoplastic elastomer, a polyurethane thermoplastic elastomer, a styrene-butadiene triblock thermoplastic elastomer, and a polyolefin thermoplastic elastomer. When using such thermoplastic elastomer, the semiconductive member is recyclable. This is preferable from the viewpoint of environmental protection. A mixture of two kinds or more of materials can be used as the material of the belt base member 51. Such a mixture can be obtained by blending a chloroprene rubber (CR) and an EPDM rubber.

Usually, an electrically conductive filler or an insulating filler is added to the belt base member 51. Thus, the volume resistivity of the belt base member 51 can be adjusted. Examples of the electrically conductive filler are metallic salts, such as $LiClO_4$ and $LiAsF_6$, carbon compounds, such as carbon black, ketchen black, and acetylene black, zinc oxide, potassium titanate, tin oxide, graphite, and various fourth-grade ammonium salts. An example of the insulating filler is silica.

The following compounds usually known as rubber compounding agents can be used. For example, fillers, such as titanium oxide, magnesium oxide, calcium carbonate, calcium sulfate, clay, talc, and silica, chemicals for rubber, such as vulcanizing agents, vulcanization accelerators, and age resistors, plasticizers, process oil, and various pigments serving as coloring agents can be used.

A material of the protective mold-releasing layer 52 is obtained by using a polyurethane resin, a polyester resin, or a polyacrylic resin as a binder and also dispersing fillers, such as lubricative fillers and electrically conductive fillers, thereinto. Examples of the lubricative filler are fine particles of a fluorocarbon resin, such as polytetrafluoroethylene (PTFE), ethylene-tetrafluoroethylene copolymer (ETFE), and ethylene tetrafluoride-perfluoroalkyl vinyl ether copolymer (PFA). When needed, a surface acting agent is dispersed thereinto. Examples of the electrically conductive filler are electronically conductive fillers and ion-conductive fillers. More specifically, the examples of the electrically conductive filler are metal oxides, such as carbon black, carbon white, titanium oxide, tin oxide, magnesium oxide, antimony silicon oxide, and aluminum oxide.

The intermediate transfer belt 20 serving as an example of the semiconductive belt, to which the present exemplary embodiment is applied, has a different resistance portion that partly differs in surface resistance value from surroundings. The present exemplary embodiment features that the different resistance portion is at a predetermined angle with respect to a direction perpendicular to an end portion of the intermediate transfer belt 20.

That is, the present exemplary embodiment features that portions, which have high electric resistance values and are generated in the process of manufacturing the semiconductive belt on the mating line (parting line) of the die and the mating line (welding line) of the material, are twisted in a circumferential direction.

The different resistance portion of the intermediate transfer belt 20 is defined to be a portion in which the absolute value ($\Delta \log \Omega$ (hereunder sometimes referred to as a resistance variation)) of the difference between a common logarithm value ($\log \Omega_H$) of the surface resistance value of the different resistance portion and a common logarithm value ($\log \Omega_L$) of the surface resistance value of each of surroundings is at least about 0.2.

Figure 3A:
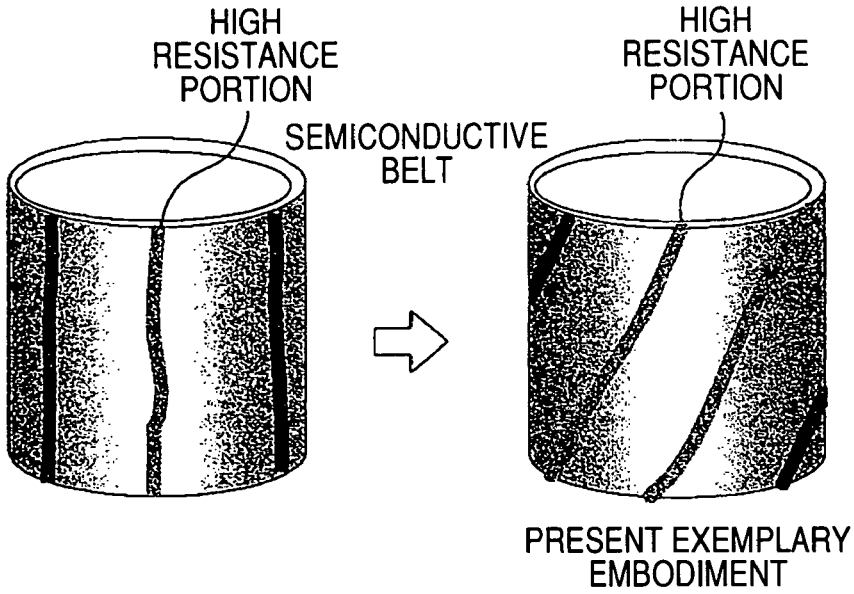
FIGS. 3A and 3B are diagrams illustrating different resistance portions provided on surfaces of semiconductive belts.
Figure 3B:
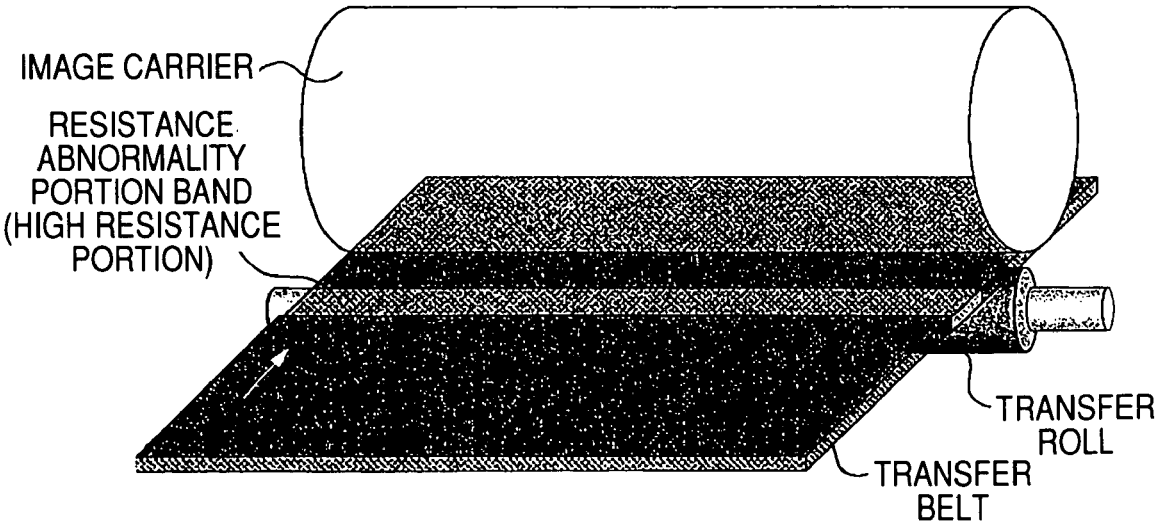

The different resistance portion is described below according to the accompanying drawing. FIGS. 3A and 3B are diagrams illustrating different resistance portions provided on the surface of the semiconductive belt. As illustrated in FIG. 3A, in the process of manufacturing the intermediate transfer belt and a paper conveyance belt, which are semiconductive belts and are used in a copying machine and a printer, defects, such as a parting line and a welding line, are generated in a local part in the surface of the belt by the press molding method and the extrusion molding method. Each of the orientation and the density of the semiconducting agent is partly changed by these defects, so that a band (that is a different resistance portion) whose electrical resistance value distribution is uneven, appears.

As shown in FIG. 3B, the band having an uneven electrical resistance value distribution is a resistance abnormality portion band in which the transferring voltage abruptly changes in a transfer process. Consequently, the transferring voltage cannot normally follow change in density, so that a desired transferring current cannot be obtained. Hence, the different resistance portion adversely affects the transfer performance with the result in uneven density defect.

Thus, according to the present exemplary embodiment shown in FIG. 3A, the different resistance portion is adapted to be at a predetermined angle with respect to a direction perpendicular to an end portion of the semiconductive belt. Consequently, each of the transferring current and the transferring voltage can be maintained to be uniform. Thus, the picture quality of an image can be maintained without being affected by the unevenness of the resistance of the electrically conductive member.

Preferably, the angle of the different resistance portion with respect to the direction perpendicular to the end portion of the intermediate belt 20 usually ranges from about 30 degrees to about 60 degrees. Also, preferably, the width of the different resistance portion usually ranges from about 0.5 mm to about 50 mm. Additionally, preferably, the number of the different resistance portions provided on the surface of the intermediate transfer belt 20 ranges from 1 to about 10.

Preferably, the volume resistivity of the intermediate transfer belt 20 ranges from about $10^3$ Ωcm to about $10^{12}$ Ωcm.

A method of manufacturing the belt base member 51 is not limited to a specific method. An optional manufacturing method can be used. However, usually, the belt base member 51 is manufactured as follows. A raw material rubber composition, in which, for example, raw material rubber, an electrically conductive filler, and a vulcanizing agent are mixed and dispersed, is kneaded by a predetermined kneader. Then, extrusion molding is performed by an extruder. At that time, the extrusion molding is performed while the mouthpiece or the core metal of the extruder is rotated. Thus, different resistance portions differing in electrical resistance value from surroundings are configured to be at a predetermined angle with respect to a direction perpendicular to an end portion of the belt.

In the case where press molding is performed using a press molding machine, the belt base member 51 is manufactured from the aforementioned raw rubber composition by using a press die having a die mating portion curved with respect to a surface of a heater plate of the press molding machine.

A method of manufacturing a semiconductive belt will be described in detail in the following description of examples.

Also, usually, it is advisable to mix and disperse the lubricative fillers and the electrically conductive filters in the resin binder and to apply this mixture onto the belt base material 51 as the protective mold-releasing layer 52 by performing a predetermined method, such as a dip coating method, a spray coating method, an electrostatic coating method, or a roll coating method. The surface roughness of the protective mold releasing layer 52 is adjusted by polishing, when needed, the base member.

Next, the semiconductive roll used in the image forming apparatus 100 according to the present exemplary embodiment is described below by taking the secondary transfer roll 30 as an example. Incidentally, the semiconductive roll according to the present exemplary embodiment can be applied not only to the secondary transfer roll 30 but to the stretched roll 22 serving as the backup roll of the secondary transfer roll 30, the primary transfer roll 25, or the charging roll of the charging unit 11. Additionally, the semiconductive roll according to the present exemplary embodiment can be applied to a developing sleeve obtained by coating the periphery of the mouthpiece with resin and then performing molding.

FIG. 2B is a diagram illustrating the secondary transfer roll 30 serving as an example of the semiconductive roll. As illustrated in FIG. 2B, the secondary transfer roll 30 has the core metal 31 and an elastic layer 32 fixed to the periphery of the core metal 31. Additionally, the secondary transfer roll 30 has a surface layer 33 optionally provided when needed. The core metal 31 is a metallic cylindrical bar made of iron or SUS. The elastic layer 32 is a cylindrical roll made of a vulcanized rubber or thermoplastic elastomer, in which electrically conductive fillers, such as carbon black, are mixed. The surface layer 33 is formed by using a polyurethane resin as a binder and also dispersing the lubricative filler and the electrically conductive filler into the binder.

Examples of the raw material rubber of the vulcanized rubber and the thermoplastic elastomer of the elastic layer are similar to those of the belt base member 51 of the aforementioned intermediate transfer belt 20. Examples of the electrically conductive filler are electronically conductive fillers and ion-conductive fillers, which are similar to those mixed into the belt base member 51 of the aforementioned intermediate transfer belt 20 and the protective mold releasing layer 52.

Incidentally, the secondary transfer roll 30 according to the present exemplary embodiment can be constituted by employing a semiconductive resin layer, which includes resin foam, as the cylindrical elastic layer 32 formed on the outer circumferential surface of the core metal 31 and also employing a polyimide resin tube or a polyetherimide resin tube as the surface layer 33.

The secondary transfer roll 30 serving as an example of the semiconductive roll, to which the present exemplary embodiment is applied, features that bands, in which physical properties, such as electric resistance values and mechanical strength values typified by a rubber hardness degree are changed in the process of manufacturing the secondary transfer roll on the mating line (parting line) of the die and the mating line (welding line) of the material, are twisted in a circumferential direction.

Especially, the secondary transfer roll 30 features that band-like different resistance portions, which partly differ in surface resistance value from surroundings, is at a predetermined angle with respect to a circumferential direction.

Incidentally, the different resistance portion of the secondary transfer roll 30 is defined to be a portion in which the absolute value (Δ log Ω (hereunder sometimes referred to as a resistance variation)) of the difference between a common logarithm value ($\log \Omega_H$) of the surface resistance value of the different resistance portion and a common logarithm value ($\log \Omega_L$) of the surface resistance value of each of surroundings is at least about 0.2.

Figure 4A:
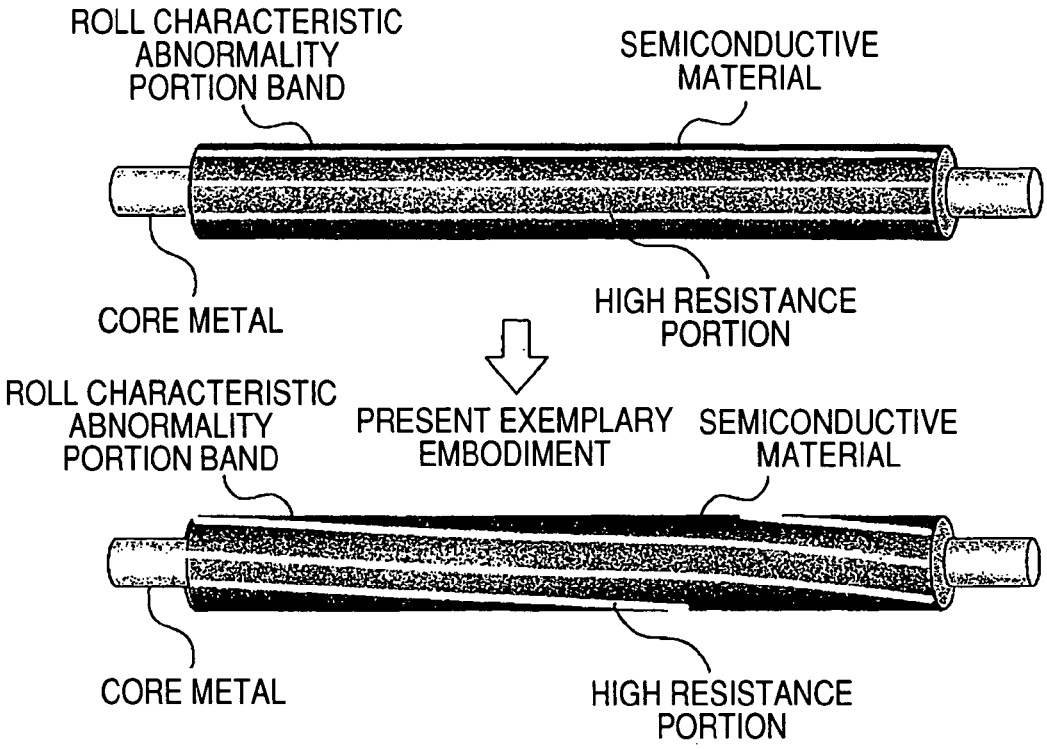
FIGS. 4A and 4B are diagrams illustrating different resistance portions provided on surfaces of semiconductive rolls.
Figure 4B:
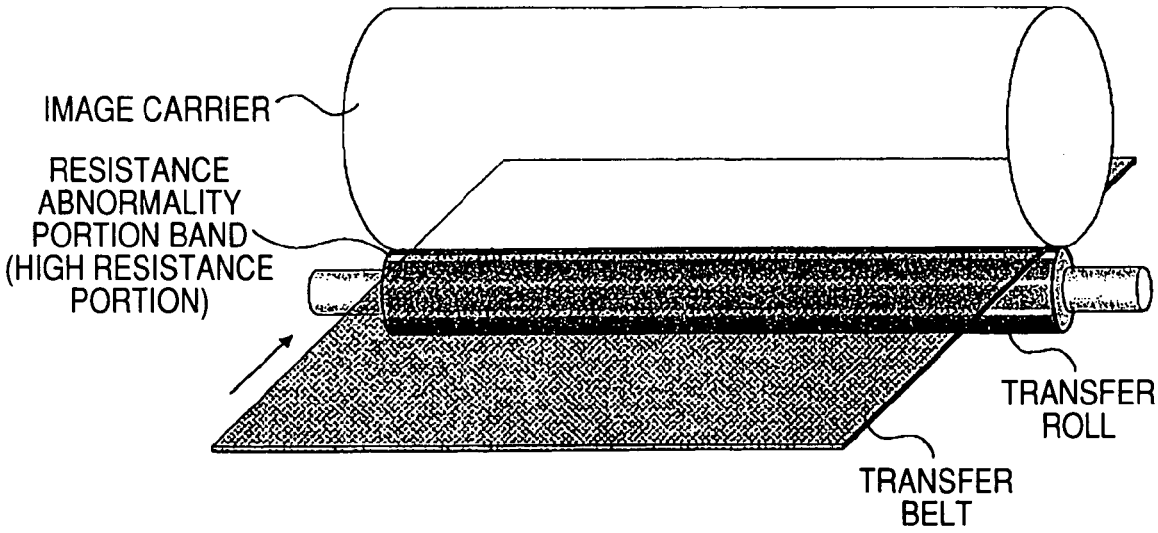

The different resistance portion is described below according to the accompanying drawing. FIGS. 4A and 4B are diagrams illustrating different resistance portions provided on the surface of the semiconductive roll. As illustrated in FIG. 4A showing a related art, in the process of manufacturing the transfer roll, which is a semiconductive roll and is used in a copying machine and a printer, defects, such as a parting line and a welding line, are generated in a local part in the surface of the roll by the press molding method and the extrusion molding method. Each of the orientation and the density of the semiconducting agent is partly changed by these defects, so that a band (that is a different resistance portion) having an uneven electrical resistance value distribution appears.

As shown in FIG. 4B, the band having an uneven electrical resistance value distribution is a resistance abnormality portion band in which the transferring voltage abruptly changes in a transfer process. Consequently, the transferring voltage cannot normally follow change in density, so that a desired transferring current cannot be obtained. Hence, the different resistance portion adversely affects the transfer performance with the result in uneven density defect.

Thus, according to the present exemplary embodiment shown in FIG. 4A, the different resistance portion is adapted to be at a predetermined angle with respect to a longitudinal direction of the semiconductive roll. Consequently, each of the transferring current and the transferring voltage can be maintained to be uniform. Thus, the picture quality of an image can be maintained without being affected by the unevenness of the resistance of the electrically conductive member.

Preferably, the angle of the different resistance portion with respect to the longitudinal direction of the secondary transfer roll 30 is usually equal to or larger than about 15 degrees. Also, preferably, the width of the different resistance portion usually ranges from about 0.5 mm to about 30 mm. Additionally, preferably, the number of the different resistance portions provided on the surface of the intermediate transfer belt 20 ranges from 1 to about 10.

Preferably, the volume resistivity of the secondary transfer roll 30 ranges from about $10^3$ Ωcm to about $10^{12}$ Ωcm.

A method of manufacturing the secondary transfer roll 30 is not limited to a specific method. An optional manufacturing method can be used. However, usually, the belt base member 51 is manufactured as follows. A raw material rubber composition, in which, for example, raw material rubber, an electrically conductive filler, and a vulcanizing agent are mixed and dispersed, is kneaded by a predetermined kneader. Then, extrusion molding is performed by an extruder. At that time, the extrusion molding is performed while the mouthpiece or the core metal of the extruder is rotated. Thus, different resistance portions differing in electrical resistance value from surroundings are configured to be at a predetermined angle with respect to a circumferential direction. That is, when the semiconductive roll is formed, the movement speed and the rotational speed of the die are adjusted, so that the different resistance portion can be at the predetermined angle with respect to the circumferential direction of the semiconductive roll.

In the case where press molding is performed using a press molding machine, the belt base member 51 is manufactured from the aforementioned raw rubber composition by using a press die having a die mating portion curved with respect to a surface of a heater plate of the press molding machine.

A method of manufacturing a semiconductive roll will be described in detail in the following description of examples.

Also, usually, it is advisable to mix and disperse the lubricative fillers and the electrically conductive filters in the resin binder and to apply this mixture onto the elastic layer 32 as the surface layer 33 by performing a predetermined method, such as a dip coating method, a spray coating method, an electrostatic coating method, or a roll coating method.

EXAMPLES

Hereinafter, the present exemplary embodiment is described in more detail with reference to examples. Incidentally, the present exemplary embodiment is not limited to the examples.

Examples and Comparative Examples of Semiconductive Belt

First Example

Rubber Compositions

Rubber compositions compounded as described in Table 1 are prepared as follows. That is, first, polymers are masticated by a kneader. Subsequently, compounding agents other than a vulcanizing agent and a vulcanizing accelerator are added to the polymers. Then, kneading is performed on this mixture for 15 minutes. Subsequently, the vulcanizing agent and the vulcanizing accelerator are added to the mixture. Then, kneading is performed on a resultant mixture by a two-roll kneader. Thus, an unvulcanized rubber composition is prepared.

Subsequently, what is called ribbon formation is performed on the unvulcanized rubber composition to thereby obtain a roll-like rubber material which has a thickness of 10 mm and also has a width of 50 mm. Then, the preforming of an endless belt is performed by an extruder.

TABLE 1

| Raw Material | Manufacturer | Compounding Quantity (Weight Parts) |
|---|---|---|
| Polychloroprene Rubber (ES-40) | DENKI KAGAKU KOGYO KABUSHIKI KAISHA | 70 |
| Epichlorohydrin Copolymer (Gechron 3106) | JAPAN ZEON CO., Ltd. | 30 |
| Carbon Black (Asahi Thermal) | Asahi Carbon Corporation | 20 |
| Ketchen Black C | Asahi Carbon Corporation | 8 |
| Zinc Oxide (Zinc Flower No. 1) | Nihon Chemical Industrial CO., Ltd. | 5 |
| Magnesium Oxide (Kyowamag 150) | Kyowa Chemical Industry Co., Ltd. | 5 |
| Process Oil (Diana PW-150) | Idemitsu Kosan Co., Ltd. | 10 |
| Sulfur (#200) | Tsurumi Kagaku Co., Ltd. | 10 |
| Vulcanization Accelerator (Nocceler TS) | Ouchi Shinko Chemical Industry Co., Ltd. | 10 |
| Vulcanization Accelerator (Nocceler DT) | Ouchi Shinko Chemical Industry Co., Ltd. | 0.5 |

Preforming

Figure 5:
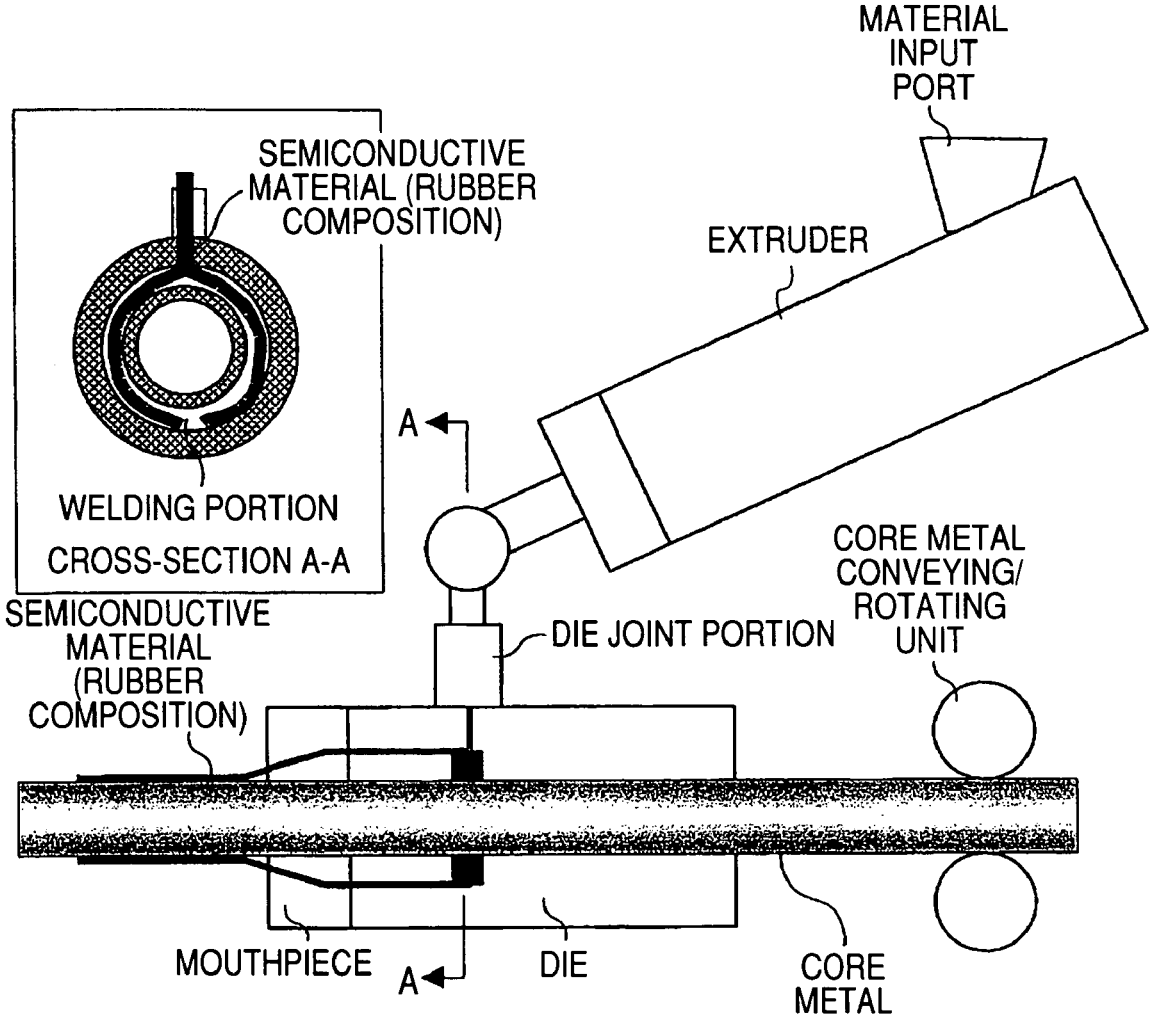
FIG. 5 is a diagram illustrating extrusion molding.

FIG. 5 is a diagram illustrating extrusion molding. As shown in FIG. 5, an unvulcanized rubber composition, which is formed like a roll by the ribbon formation and is then inputted by a material input port, is fed to a die by a screw provided in the extruder. During, this time in which the rubber composition is fed from the extruder to the die, the temperature is controlled by a band heater to range from about 50° C. to 100° C. The viscosity of the rubber composition is lowered, as compared with that of the rubber composition in the vicinity of the input port, so that the rubber composition can smoothly flow through a narrow mouthpiece.

The present exemplary embodiment employs a square type extruder configured so that rubber compositions are fed from the side of a die. The structure of the die is devised so that an endless belt can be formed by providing a ring-like groove therein, and that the rubber compositions join together in the die. In this case, the number of a welding line provided therein is 1.

Materials discharged from the extruder proceeds into the die through a die joint portion. Thus, a welding portion is caused in the cylindrical die, as shown in a cross-sectional view taken along line A-A. This junction portion covers the core metal and is not rotated.

Figure 6A:
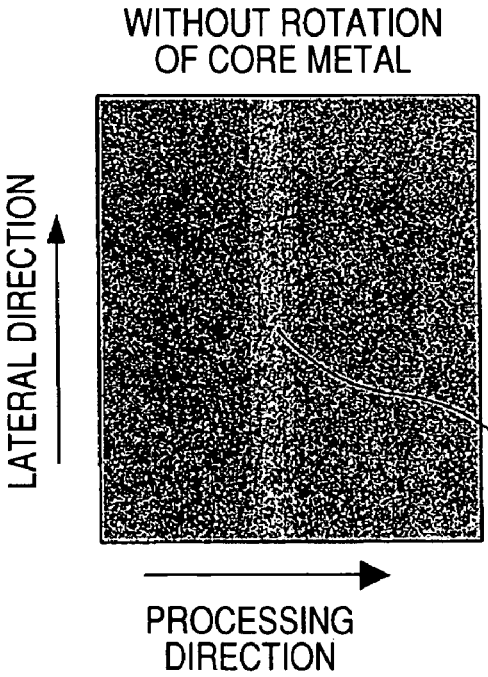
FIGS. 6A and 6B are views illustrating resistance mapping performed in a lateral direction of an endless belt.
Figure 6B:
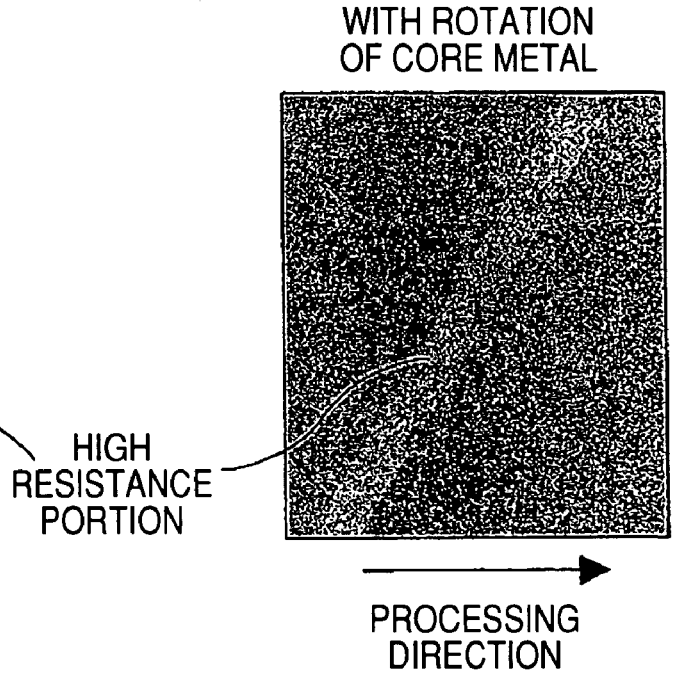

In the present exemplary embodiment, a different resistance portion partly differing in electrical resistance value from surroundings is formed by extrusion molding while the core metal is rotated by a core metal conveyance rotation unit, so that the different resistance portion extends obliquely in a lateral direction of an endless belt. FIGS. 6A and 6B are views illustrating resistance mapping in the lateral direction of the endless belt. As shown in FIG. 6A, when the extrusion molding is performed without rotating the core metal, a different resistance portion is formed in a part of the surface of the belt, which corresponds to the welding line. However, when the extrusion molding is performed while rotating the core metal, a different resistance portion is formed obliquely with respect to a lateral direction of the endless belt.

Vulcanization

Steam vulcanization (a vulcanization temperature is 160° C., and a vulcanization time is 30 minutes) is performed on the preformed endless belt in a vulcanizer. Subsequently, the front and rear surfaces of the belt are grounded by a cylindrical grinder to thereby finish the belt so that the thickness of the belt is 0.5 mm. Then, polishing powder is removed therefrom. Subsequently, spray coating is performed on the surface of the endless belt using fluorocarbon resin (antistatic coating agent JLY-601ESD manufactured by Acheson (Japan) Limited), so that a protection mold releasing layer having a thickness of 0.01 mm is formed thereon. Thus, a semiconductive belt is prepared.

Resistance Measurement

The volume resistivity and the resistance variation of the semiconductive belt prepared by the aforementioned method are measured. The volume resistivity thereof is performed according to a measurement method described in JP-A-06-118105. That is, a voltage of 500 volts is applied thereto. The area of a turnably mounted semiconductive belt inner ring is reduced to 0.05 $mm^2$. Then, the volume resistivity is continuously measured over the entire belt.

Incidentally, in the semiconductive belt prepared in the present exemplary embodiment, the generated welding line has a resistance value which is 3 times that of a non-welding portion due to the structure of the die, so that a different resistance portion is formed to have a width of 15 mm.

Picture Quality Evaluation

Figure 7A:
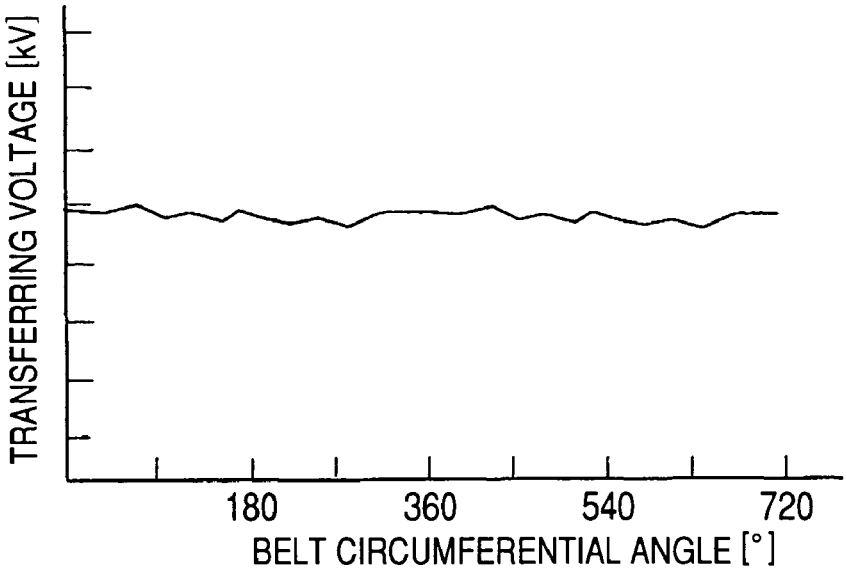
FIGS. 7A and 7B are graphs illustrating results of monitoring a transferring voltage.
Figure 7B:
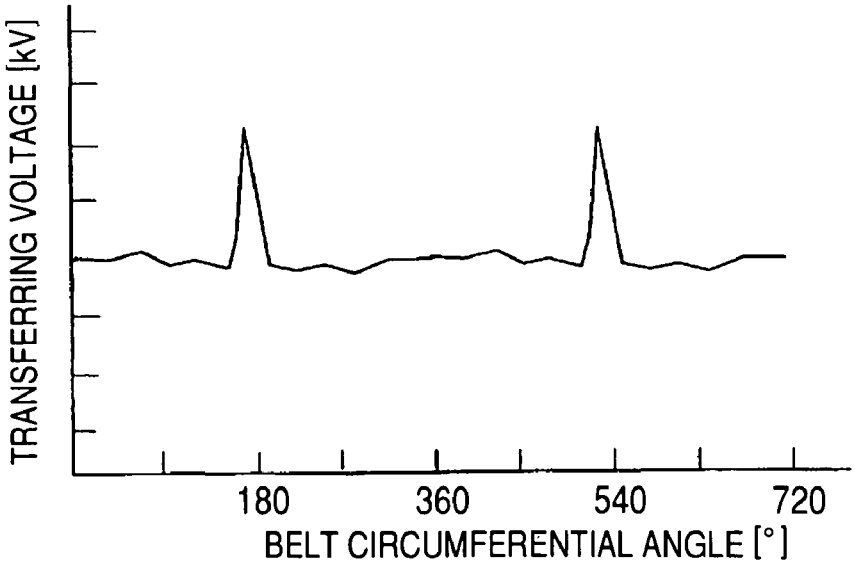

Picture quality, that is, a transferring potential variation and image quality (or transfer failure) are evaluated by using an image forming apparatus (DocuPrint C525A manufactured by Fuji Xerox Printing System Co., Ltd.) that employs this semiconductive belt. FIGS. 7A and 7B are graphs illustrating results of monitoring a transferring voltage over two turns of the belt. As shown in FIG. 7A, in the case of the semiconductive belt prepared according to the present exemplary embodiment, no singular value of the transferring voltage (kV) is observed at circumferential angles of the belt in a range from 0 to 360°.

Table 2 shows results of evaluating a common logarithmic value (Log Ω) of the volume resistivity, a resistance variation (Δ Log Ω), the transferring potential variation (kV), and the image quality (the transferring variation).

Second Example

Figure 8A:
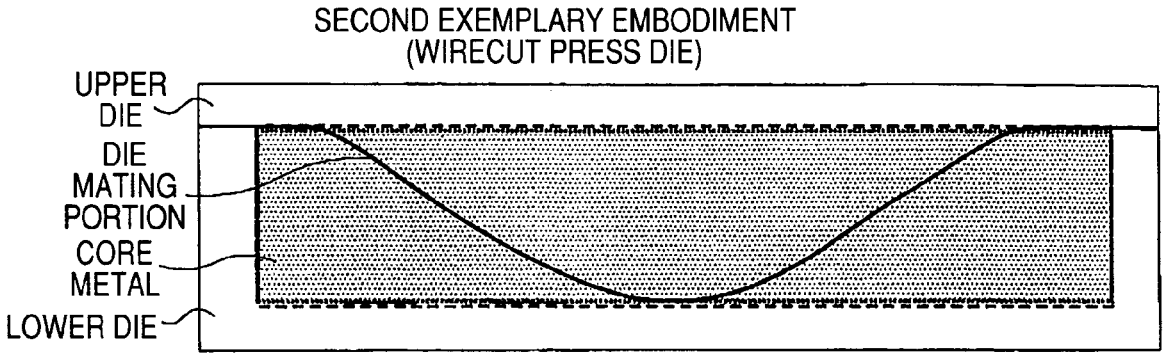
FIGS. 8A and 8B are cross-sectional diagrams illustrating a die.
Figure 8B:
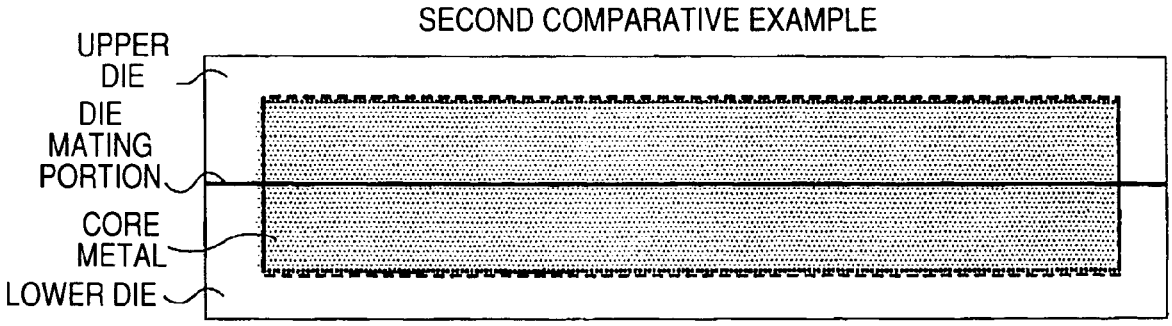

A semiconductive belt is formed by using the rubber composition (see Table 1) used in the first exemplary embodiment and also performing press molding (a vulcanization temperature is 160° C., and a vulcanization time is 25 minutes). The die obtained by spirally dividing a mating portion through wire-cutting is used. FIGS. 8A and 8B are cross-sectional diagrams illustrating the die. As shown in FIG. 8A, a wirecut press die is configured so that a core metal is disposed therein, and that the mating portion between an upper die and a lower die is spirally formed by wire-cutting.

Table 2 also shows results of evaluating, according to a technique similar to that used in the first exemplary embodiment, the common logarithmic value (Log Ω) of the volume resistivity, the resistance variation (Δ Log Ω), the transferring potential variation (kV), and the image quality (the transferring variation) of a semiconductive belt prepared by press-molding.

First Comparative Example

A semiconductive belt is formed by using the rubber composition (see Table 1) used in the first exemplary embodiment and also using an extruder, which is similar to that used in the first exemplary embodiment, and performing molding on a covered unvulcanized rubber composition without rotating a core metal.

A different resistance portion having a resistance value higher than those of surroundings by a value corresponding to 1.5 digits is formed in a range having a width of 15 mm in a direction perpendicular to a processing direction in a surface of the prepared semiconductive belt, which corresponds to a welding line generated during extrusion molding.

Incidentally, as shown in FIG. 7B, in the case of the semiconductive belt prepared in the present comparative example, singular values of the transferring voltage (kV) are observed at about 180° and about 540° (corresponding to 180° on a first turn of the belt) in a circumferential direction of the belt within a range from 0 to 720° (corresponding to 2 turns of the belt).

The common logarithmic value (Log Ω) of the volume resistivity, the resistance variation (Δ Log Ω), the transferring potential variation (kV), and the image quality (the transferring variation) of the semiconductive belt prepared in this way are measured according to a technique similar to that used in the first exemplary embodiment. Table 2 shows results of the measurement.

Second Comparative Example

A semiconductive belt is formed by using the rubber composition (see Table 1) used in the first exemplary embodiment and also performing press molding using a die (a vulcanization temperature is 160° C., and a vulcanization time is 25 minutes).

Figure 9A:
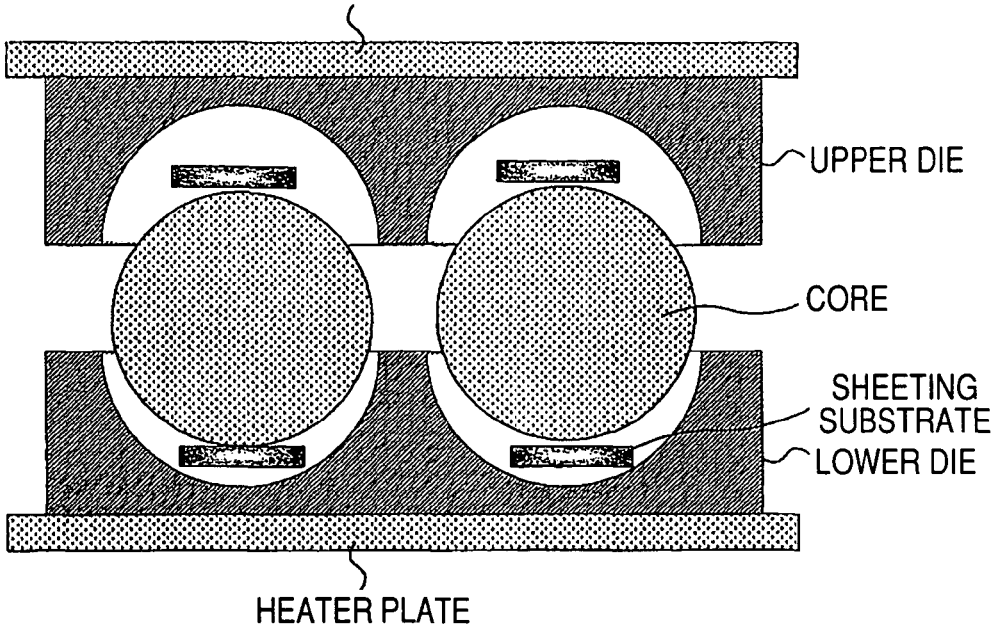
FIGS. 9A and 9B are diagrams illustrating press molding performed using an ordinary two-piece press die.
Figure 9B:
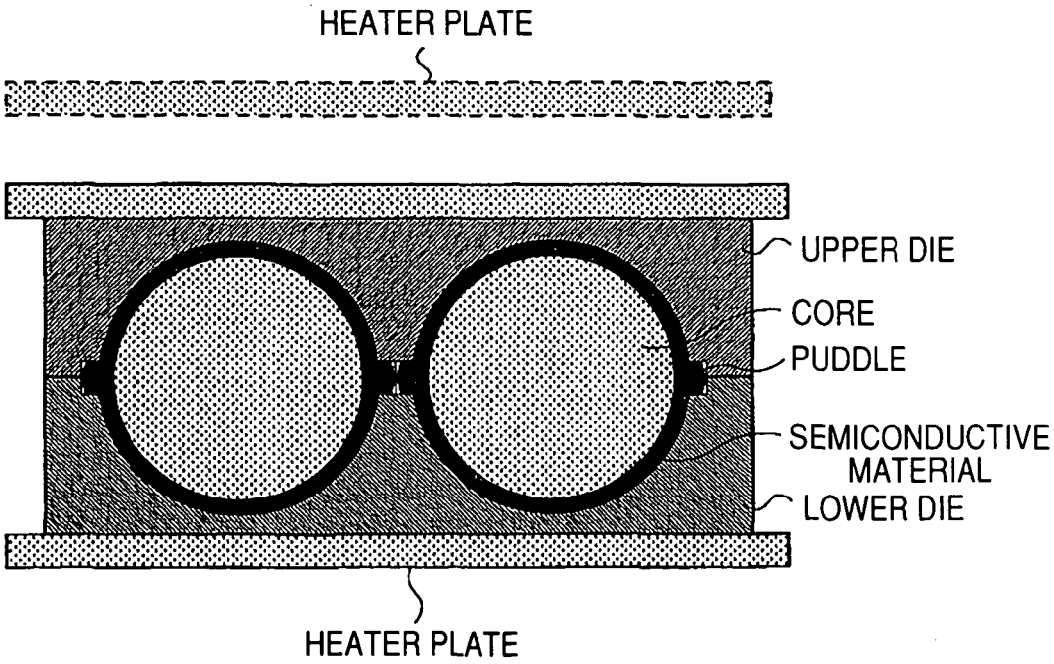

As shown in FIG. 8B, the die having an ordinary two-piece structure is used. FIGS. 9A and 9B are diagrams illustrating press molding performed by using the press die of the ordinary two-piece structure. In the case of the semiconductive belt prepared by press molding using this die, a die mating portion has a large resistance value, so that the belt exhibits a high resistance value. Also, the rubber hardness degree at the die mating portion is low. After polishing, a dent is observed in the die mating portion.

The common logarithmic value (Log Ω) of the volume resistivity, the resistance variation (Δ Log Ω), the transferring potential variation (kV), and the image quality (the transferring variation) of the semiconductive belt prepared by press-molding are measured according to a technique similar to that used in the first exemplary embodiment. Table 2 shows results of the measurement.

TABLE 2

| | Examples | | Comparative Examples | |
|---|---|---|---|---|
| | 1 | 2 | 1 | 2 |
| Volume Resistance Value (LogΩ) | 7-8 | 7-8 | 7-8 | 7-8 |
| Resistance Variation (ΔLogΩ) | 0.5 | 0.8 | 0.5 | 0.8 |
| Transfer Potential Variation (kV) | 0.4 | 0.4 | 1.1 | 1.8 |
| Picture Quality (Transfer Failure) | Good | Good | Bad | Bad |

The results shown in Table 2 show that in the semiconductive belts respectively prepared by the extrusion molding performed in the first exemplary embodiment while rotating the core metal and by the press molding using the die whose die mating portion is divided by wire-cutting, different resistance portions, each of which is adapted to be partly higher in surface resistance value than surroundings, are formed obliquely in the lateral direction of the endless belt. Thus, the transferring potential variation is low (0.4 kV). Consequently, the stability of the transferring voltage is considerably improved. Also, good picture quality of images having no leakage and voids can be obtained.

Conversely, the semiconductive belts prepared according to the related art (the first comparative example and the second comparative example) cannot achieve the enhancement of the stability of the transferring voltage.

Thus, according to the present exemplary embodiment, the different resistance portions are formed obliquely with respect to the lateral direction of the transfer belt to thereby stabilize transferring currents required to perform the primary transfer and the secondary transfer using the transfer roll disposed on the rear surface of the belt. Consequently, a transfer system, which is excellent at transfer performance, can be realized. Also, a high picture quality image forming apparatus can be provided.

The resistance variation in the belt is dispersed, so that power supply capacity can be reduced to a small value. The miniaturization of the power supply and the saving of energy can be achieved.

Also, abrupt change in the transferring voltage can be suppressed. Occurrence of a leakage phenomenon due to the generation of a high voltage can be suppressed. Damage to the transfer member can be suppressed. The durability of the transfer member is enhanced.

Next, examples of the semiconductive roll and comparative examples are described below.

Third Example

Extrusion Coating Molding

A 66-nylon composition shown in Table 3 is kneaded by a two-axis kneader. Thus, a granular (pellet) material, which has a diameter ϕ of 2 mm and a length ranging from 5 mm to 10 mm, are manufactured. Subsequently, the granular (pellet) material is input to an extruder from a material input port. Then, the input material is molten in a barrel (or cylinder) in which a single-axis screw heated by a band heater rotates. Subsequently, the molten material is conveyed into the die. FIG. 5 is a view illustrating the extruder. The die of the crosshead type is used. The parted 66-nylon compositions conveyed into the die joined together through a torus-shaped manifold, so that the 66-nylon composition is shaped like a cylinder. Then, while the cylindrical shape of the 66-nylon composition is maintained, the core metal is coated with this composition going thereinto from the mouthpiece. Then, molding is performed thereon. The core metal may be heated when needed. In the case of the present exemplary embodiment, the core metal is used at ambient temperature. A hollow aluminum member, which is shaped to have a diameter ϕ of 20 mm and a thickness of 2 mm, is used as the core metal. Incidentally, the present exemplary embodiment employs the die of a structure having only one parting line. However, in the structure of the die, the parting portion can be divided into a plurality of parting parts. Alternatively, a die runner may be adapted to have a multi fractional structure.

A core metal feeding speed is changed according to a speed at which the nylon-12 composition is extruded. While the core metal is conveyed, a core metal supplying speed is controlled using the core metal conveyance rotation unit provided in rear of the die. The accuracy of the core metal supplying speed affects an extrusion film thickness. Thus, it is necessary that the accuracy of the core metal supplying speed is at the same level as the accuracy of feeding the core metal. To prevent occurrence of a rectilinear course of the welding line, a twisting mechanism is provided in a feeding unit. Thus, the core metal is fed while rotated. The relation between the feeding of the core metal and the rotation thereof is adjusted so that the core metal is rotated by 360 degrees while the core metal is conveyed by 300 mm. Incidentally, the core metal may be drawn back upon completion of coat-molding of the surface of the core metal.

TABLE 3

| Raw Material | Manufacturer | Compounding Quantity (Weight Parts) |
|---|---|---|
| Nylon-12 (DAIAMIDL1801) | Daicel-Hulse, Ltd | 100 |
| Potassium titanate Whisker (DENTALL BK200) | Otsuka Chemical Co., Ltd. | 20 |
| Carbon Black (Asahi Thermal) | Asahi Carbon Corporation | 20 |
| Ketchen Black C | Asahi Carbon Corporation | 8 |

Semiconductive Sleeve Preparation

The 66-nylon composition used for coat-molding of the core metal is in a softened state. Thus, the 66-nylon composition is hardened by a cooling unit. In the present exemplary embodiment, water shower cooling is employed as cooling unit. Subsequently, the 66-nylon composition is shaped by a lathe to form a member having a predetermined length and a predetermined diameter. Also, this member is finished so that the thickness of the coat is 0.8 mm. Then, aluminum caps are inserted into both ends of this member. Thus, a semiconductive sleeve is prepared.

Resistance Measurement

Similarly to the case of the semiconductive belt, the volume resistivity and the resistance variation of the semiconductive sleeve prepared by the aforementioned method are measured. The volume resistivity thereof is performed according to the measurement method described in JP-A-06-118105. That is, a voltage of 100 volts is applied thereto. Then, the volume resistivity is continuously measured over the entire semiconductive sleeve. The measurement of the resistance variation of the sleeve is performed at each rotating angle of 10 degrees and at every 5 mm in an axial direction.

Picture Quality Evaluation

Similarly to the case of the semiconductive belt, picture quality, that is, a transferring potential variation, a durability (or cracks) and image quality (or transfer failure) are evaluated by using an image forming apparatus (DocuPrint C525A manufactured by Fuji Xerox Printing System Co., Ltd.) that employs this semiconductive sleeve.

Table 4 shows results of evaluating a common logarithmic value (Log Ω) of the volume resistivity, the resistance variation (Δ Log Ω), the transferring potential variation (kV), the durability (the cracks), and the image quality (the transferring variation).

Fourth Example

BTR

Figure 10:
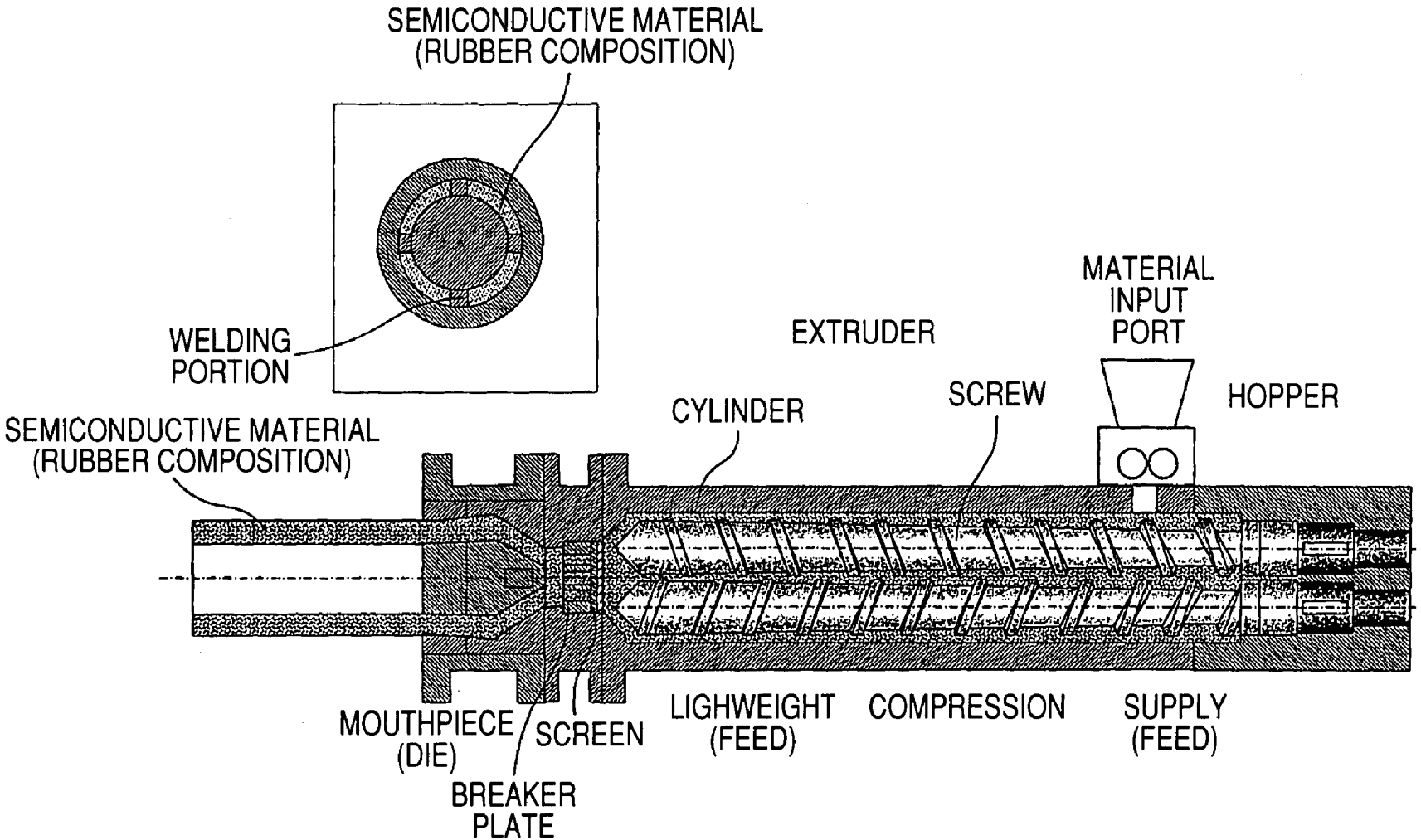
FIG. 10 is a diagram illustrating an extruder of the straight die type.

First, what is called the ribbon formation is performed on an unvulcanized rubber composition by using the rubber composition used in the first exemplary embodiment (see Table 1), thereby to obtain a roll-like rubber material which has a thickness of 10 mm and also has a width of 50 mm. Then, the preforming of a semiconductive roll is performed by an extruder. FIG. 10 is a diagram illustrating an extruder of the straight die type. The extruder shown in FIG. 10 is a two-axis extruder having two screws provided in a cylinder.

Preforming

The rubber composition, on which what is called the ribbon formation is performed, is supplied from a material input port of the extruder shown in FIG. 10 and is then kneaded by the two-axis screws. A cylinder portion is configured so that the temperature of the rubber composition is controlled by a heater and goes toward a strainer. The rubber composition passes through a mesh-like screen and a honeycomb-like breaker plate and go into the die in which an inner die and an outer die are suspended with four joints. The rubber composition is once separated at the four joints. After the parted rubber compositions passes through the joints, the rubber compositions join together, so that the rubber composition changes the shape into a cylindrical shape. Subsequently, the rubber composition goes to an outlet port of the mouthpiece, so that a member having a predetermined inside diameter and a predetermined outside diameter is formed. In the case of the present exemplary embodiment, this member having an inside diameter ϕ of 8 mm and an outside diameter ϕ of 18 mm is preformed.

Core Metal Insertion

To enhance the accuracy of the inside diameter of the roll, the core metal is inserted into the preformed unvulcanized rubber composition. Because the rectilinearity of the welding line occurs according to an ordinary core metal insertion method, the core metal is inserted while the unvulcanized rubber composition is rotated.

Vulcanization

Steam vulcanization (a vulcanization temperature is 160° C., and a vulcanization time is 1 hour) is performed on the preformed roll in a vulcanizer. Subsequently, the front and rear surfaces of the roll are grounded by a cylindrical grinder to thereby finish the roll so that the thickness of the belt is 0.5 mm. Then, polishing powder is removed therefrom. Subsequently, spray coating is performed on the surface of the roll using fluorocarbon resin (antistatic coating agent JLY-601ESD manufactured by Acheson (Japan) Limited), so that a protection mold releasing layer having a thickness of 0.01 mm is formed thereon. Thus, a semiconductive roll (BTR) is prepared.

Table 4 also shows results of evaluating, according to a technique similar to that used in the fourth exemplary embodiment, the common logarithmic value (Log Ω) of the volume resistivity, the resistance variation (Δ Log Ω), the transferring potential variation (kV), a durability (or cracks) and the image quality (the transferring variation) of a semiconductive roll prepared by press-molding.

Third Comparative Example

A semiconductive sleeve is prepared by using the 66-nylon composition (see Table 3) used in the third exemplary embodiment and also using an extruder similar to that used in the third exemplary embodiment and by coat-molding the 66-nylon composition without rotating the core metal. In the prepared semiconductive sleeve, a different resistance portion, whose resistance value is higher than surroundings by a value corresponding to 0.5 digits, is formed in a range, whose width is 8 mm, in a direction perpendicular to a processing direction in a surface corresponding to a welding line generated when extrusion-molding is performed. Additionally, spray coating is performed on the surface using fluorocarbon resin (antistatic coating agent JLY-601ESD manufactured by Acheson (Japan) Limited). However, a high resistance portion corresponding to the welding line notably appeared.

Table 4 shows results of measuring, according to a technique similar to that used in the third exemplary embodiment, a common logarithmic value (Log Ω) of the volume resistivity, the resistance variation (Δ Log Ω), the transferring potential variation (kV), the durability (the cracks), and the image quality (the transferring variation).

Fourth Comparative Example

A semiconductive roll is formed by using the rubber composition (see Table 1) used in the first exemplary embodiment and also performing press molding using the press die having an ordinary two-piece structure shown in FIG. 8B (a vulcanization temperature is 160° C., and a vulcanization time is 25 minutes). In the semiconductive roll prepared by press molding using this die, a die mating portion is high in resistance value. Also, the rubber hardness degree at the die mating portion is low. After polishing, a dent is observed in the die mating portion. Additionally, regarding the evaluation of the durability, cracks are generated in the welding portion.

Table 4 shows results of measuring, according to a technique similar to that used in the third exemplary embodiment, a common logarithmic value (Log Ω) of the volume resistivity, the resistance variation (Δ Log Ω), the transferring potential variation (kV), the durability (the cracks), and the image quality (the transferring variation) of the semiconductive roll prepared by press-molding.

TABLE 4

| | Examples | | Comparative Examples | |
|---|---|---|---|---|
| | 3 | 4 | 3 | 4 |
| Volume Resistance Value (LogΩ) | 6-7 | 6-7 | 6-7 | 6-7 |

TABLE 4-continued

| | Examples | | Comparative Examples | |
|---|---|---|---|---|
| | 3 | 4 | 3 | 4 |
| Resistance Variation (ΔLogΩ) | 0.5 | 0.8 | 0.5 | 0.9 |
| Transfer Potential Variation (kV) | 0.4 | 0.4 | 1.1 | 1.8 |
| Durability (Crack) | Good | Good | Good | Bad |
| Picture Quality (Transfer Failure) | Good | Good | Bad | Bad |

The results shown in Table 4 show that in the semiconductive belts respectively prepared by the extrusion molding performed in the third and fourth exemplary embodiments while rotating the core metal, different resistance portions, each of which is adapted to be partly higher in surface resistance value than surroundings, are formed obliquely in the lateral direction of the semiconductive roll. Thus, the transferring potential variation is low (0.4 kV). Consequently, the stability of the transferring voltage is considerably improved. Also, good picture quality of images having no leakage and voids can be obtained. Also, no cracks are formed, so that the durability is high.

Conversely, the semiconductive rolls prepared according to the related art (the third comparative example and the fourth comparative example) have a tendency toward low durability and cannot achieve the enhancement of the stability of the transferring voltage.

Fifth Example

BCR

Press molding using the wirecut press die shown in FIGS. 8A and 8B is performed (a vulcanization temperature is 160° C., and a vulcanization time is 25 minutes) on the rubber composition (see Table 1) used in the first exemplary embodiment. Thus, a semiconductive roll (BCR) causing no cracks is obtained. Although the structure of the die is complex, sufficient advantages are obtained.

Sixth Example

Foam BTR+TUBE

Steam vulcanization is performed in a vulcanizer by using the rubber composition (see Table 1) used in the first exemplary embodiment and by injecting the rubber composition thereinto and performing extrusion molding while a mouthpiece is rotated. Subsequently, a polished semiconductive roll, whose outside diameter is adjusted by a cylindrical grinder, is coated with a polyimide tube and is used as a transfer roll. In the case of using a base material, on which extrusion molding is performed by twisting the welding line, cleaning is sufficiently achieved. Also, no uneven abrasion is caused. Incidentally, in the case of the rubber composition, on which extrusion molding is performed without rotating the mouthpiece or the core metal, uneven abrasion is caused by a metallic scraper used to clean the surface of the transfer roll, so that a cleaning defect occurs. Incidentally, even when the extrusion molding of the rubber composition is performed while the core metal is rotated, similar advantages are obtained.

Seventh Example

Vulcanization is performed on unvulcanized rubber, on which extrusion molding is performed, in a vulcanizer by using the rubber composition (see table 1) used in the first exemplary embodiment. Subsequently, the core metal, to which a vulcanized adhesive agent is applied, is lightly pressed into vulcanized rubber while being rotated. Thereafter, the rubber is left untouched at 160 degrees for 15 minutes. Thus, a semiconductive roll is prepared.

Thus, similarly to the semiconductive belt, the different resistance portion is formed obliquely with respect to the lateral direction of the semiconductive roll. Thus, a transfer system, which excels at transfer performance, can be realized. Consequently, a high picture quality image forming apparatus can be provided.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

FIG. 2A

20 INTERMEDIATE TRANSFER BELT

52 PROTECTIVE MOLD-RELEASING LAYER

51 BELT BASE MEMBER

FIG. 2B

30 SECONDARY TRANSFER ROLL

33 SURFACE LAYER

32 ELASTIC LAYER

31 CORE METAL

FIG. 3A

#1:HIGH RESISTANCE PORTION

#2:SEMICONDUCTIVE BELT

#3:RELATED ART

#4:PRESENT EXEMPLARY EMBODIMENT

FIG. 3B

#5:IMAGE CARRIER

#6:RESISTANCE ABNORMALITY PORTION BAND HIGH RESISTANCE PORTION

#7:TRANSFER ROLL

#8:TRANSFER BELT

FIG. 4A

#9:RELATED ART

#10:ROLL CHARACTERISTIC ABNORMALITY PORTION BAND

#11:SEMICONDUCTIVE MATERIAL

#12:CORE METAL

#13:HIGH RESISTANCE PORTION

#14:PRESENT EXEMPLARY EMBODIMENT

FIG. 4B
#15:IMAGE CARRIER
#16:RESISTANCE ABNORMALITY PORTION BAND HIGH RESISTANCE PORTION
#17:TRANSFER ROLL
#18:TRANSFER BELT
FIG. 5
#19:MATERIAL INPUT PORT
#20:SEMICONDUCTIVE MATERIAL (RUBBER COMPOSITION)
#21:EXTRUDER
#22:WELDING PORTION
#23:CROSS-SECTION A-A
#24:DIE JOINT PORTION
#25:CORE METAL CONVEYING/ROTATING UNIT
#26:SEMICONDUCTIVE MATERIAL (RUBBER COMPOSITION)
#27:CORE METAL
#28:MOUTHPIECE
#29:DIE
FIG. 6A, FIG. 6B
#30:WITHOUT ROTATION OF CORE METAL
#31:WITH ROTATON OF CORE METAL
#32:LATERAL DIRECTION
#33:HIGH RESISTANCE PORTION
#34:PROCESSING DIRECTION
FIG. 7A, FIG. 7B
#35:FIRST EXAMPLE
#36:TRANSFERRING VOLTAGE
#37:BELT CIRCUMFERENTIAL ANGLE
#38:FIRST COMPARTIVE EXAMPLE
FIG. 8A, FIG. 8B
#39:SECOND EXEMPLARY EMBODIMENT (WIRECUT PRESS DIE)
#40:UPPER DIE
#41:DIE MATING PORTION
#42:CORE METAL
#43:LOWER DIE
#44:SECOND COMPARATIVE EXAMPLE
FIG. 9A, FIG. 9B
#45:SECOND COMPARATIVE EXAMPLE (DIE)
#46:HEATER PLATE
#47:UPPER DIE
#48:CORE
#49:SHEETING SUBSTRATE
#50:LOWER DIE
#51:SECOND COMPARATIVE EXAMPLE (PRESS MOLDING)
#52:PUDDLE
#53:SEMICONDUCTIVE MATERIAL
FIG. 10
#54:SEMICONDUCTIVE MATERIAL (RUBBER COMPOSITION)
#55:EXTRUDER
#56:MATERIAL INPUT PORT
#57:WELDING PORTION
#58:CYLINDER
#59:SCREW
#60:HOPPER
#61:SEMICONDUCTIVE MATERIAL (RUBBER COMPOSITION)
#62:MOUTHPIECE (DIE)
#63:BREAKER PLATE
#64:SCREEN
#65: LIGHWEIGHT (FEED)
#66: COMPRESSION
#67: SUPPLY (FEED)

What is claimed is:

1. A semiconductive belt comprising:

a first portion having a first electric resistance and being formed on the semiconductive belt; and a second portion having a second electric resistance different from the first electric resistance, the second portion being formed on the semiconductive belt so as to extend from one end of the semiconductive belt to another end of the semiconductive belt, wherein the second portion has a width ranging from about 0.5 mm to about 50 mm, and an angle from about 30 degrees to about 60 degrees with respect to a direction perpendicular to a belt end portion, and the one end and the other end are parallel with the direction perpendicular to a belt end portion.

2. The semiconductive belt according to claim 1, wherein the number of the second portion ranges from 1 to 10.

3. The semiconductive belt according to claim 1, further comprising an electrically conductive filler, and a member selected from the group consisting of rubbers and thermoplastic elastomers.

4. The semiconductive belt according to claim 3, wherein the electrically conductive filler has ionic conductivity or electronic conductivity.

5. The semiconductive belt according to claim 1, wherein the semiconductive belt has a volume resistivity ranging from about $10^3$ Ω·cm to about $10^{12}$ Ω·cm.

6. The semiconductive belt according to claim 1, further comprising:

a belt member containing a rubber material; and at least one additional layer on the belt member.

7. A semiconductive roll comprising:

a first portion having a first electric resistance and being formed on the semiconductive roll; and a second portion having a second electric resistance different from the first electric resistance, the second portion being formed on the semiconductive roll so as to extend from one end of the semiconductive roll to another end of the semiconductive roll, wherein the second portion has a width ranging from about 0.5 mm to about 50 mm, and an angle from about 15 degrees to about 60 degrees with respect to a longitudinal direction of the semiconductive roll, and the one end and the other end are parallel with the longitudinal direction.

8. The semiconductive roll according to claim 7, wherein an absolute value (Δ log Ω) of a difference between a common logarithm value (log $\Omega_H$) of a surface resistance value of the second portion and a common logarithm value (log $\Omega_L$) of a surface resistance value of the first portion is at least about 0.2.

9. The semiconductive roll according to claim 7, further comprising a semiconductive elastic layer containing an ionic conductivity filler or an electronic conductivity filler, wherein the semiconductive elastic layer has a volume resistivity ranging from about $10^3$ Ωcm to about $10^{12}$ Ωcm.

* * * * *